US006374411B1

(12) United States Patent
Duhn

(10) Patent No.: US 6,374,411 B1
(45) Date of Patent: Apr. 23, 2002

(54) SECURED BIB

(76) Inventor: Paula S. Duhn, 1431 Keegan Way, Santa Ana, CA (US) 92705

( * ) Notice: Subject to any disclaimer, the term of this patent is extended or adjusted under 35 U.S.C. 154(b) by 0 days.

(21) Appl. No.: 09/801,074

(22) Filed: Mar. 8, 2001

(51) Int. Cl.[7] ..... A41B 13/10
(52) U.S. Cl. ..... 2/49.1; 2/49.3; 2/50
(58) Field of Search ..... 2/49.3, 49.2, 49.1, 2/51, 48, 50, 46, 49.4, 52

(56) References Cited

U.S. PATENT DOCUMENTS 83,120 A * 10/1868 Mott ..... 2/49.5
590,991 A * 10/1897 Lenhart ..... 2/49.2
1,149,950 A * 8/1915 Rindskopf ..... 119/850
1,284,252 A * 11/1918 Dalton ..... 2/49.3
2,224,746 A * 12/1940 Richstein ..... 2/46
2,424,000 A * 7/1947 Shanker ..... 2/49.1
2,532,932 A * 12/1950 Neiswander ..... 2/49.2
2,643,384 A * 6/1953 Thompson ..... 2/49.3
3,879,762 A * 4/1975 Herman ..... 2/48
5,915,530 A * 6/1999 Hager ..... 2/49.3
6,021,521 A * 2/2000 Baratta ..... 2/49.1

* cited by examiner

*Primary Examiner*—Amy B. Vanatta
(74) *Attorney, Agent, or Firm*—G. Donald Weber, Jr.

(57) ABSTRACT

A protective device (i.e. bib) for covering at least a portion of a wearer's person and/or clothing during procedures such as eating, application of make-up, hair cutting or the like.

The protective device includes a neck attachment adjacent one end and a securing device adjacent the other end.

The neck attachment secures one end of the protective device to the wearer and the securing device secures the other end of the protective device to the wearer, the wearer's attire or some other fixed point to inhibit removal of the protective device.

6 Claims, 2 Drawing Sheets

SECURED BIB

BACKGROUND

1. Field of the Invention

This invention relates to protective devices such as bibs, in general, and, more particularly, to protective devices which can be secured in place on the wearer.

2. Prior Art

Protective devices, commonly referred to as bibs, are well known in the art. Bibs are used for many purposes such as hair cutting, makeup application and the like. However, the most widespread use of bibs is as a protective covering while eating. In this use, the bib is used to protect the garments of the bib user in many eating activities. For example, bibs are often used by adults while eating certain foods which can be messy. Typical usages are in eating spaghetti (or other pasta dishes), lobster or the like.

In addition, bibs are often used or required if the wearer has a physical disability and tends to spill or drop foodstuffs while eating. Other uses are well known.

Most often, however, bibs are associated with infants or small children. In the case of youngsters, the bib is most often associated with eating and/or regurgitation which processes can often become messy or sloppy.

While most bibs can be secured at the upper end thereof by attachment to the neck of the wearer, the bottom end of the known bibs tends to come loose, be pulled up, drag in the food or merely be relocated out of the proper coverage location. Thus the usefulness of the conventional bib can be substantially reduced. A solution to this problem is highly desirable.

SUMMARY OF THE INSTANT INVENTION

This invention relates to a protective device, typically referred to as a bib, for covering at least a portion of a wearer's person and/or clothing during various procedures such as eating, application of make-up, hair cutting or the like. Typically, the bib includes a neck attachment, for example a neck hole, adjacent one end of the bib and a securing device such as a clip or clamp adjacent the other end of the bib.

The neck attachment, i.e. a hold in a pullover bib or an adjustable collar, secures the upper end of the bib to the wearer. The securing device or clip secures the other end of the bib to the wearer, the wearer's attire or some other fixed point to inhibit removal of the bib from the desired protection area.

DESCRIPTION OF A PREFERRED EMBODIMENT

Figure 1:
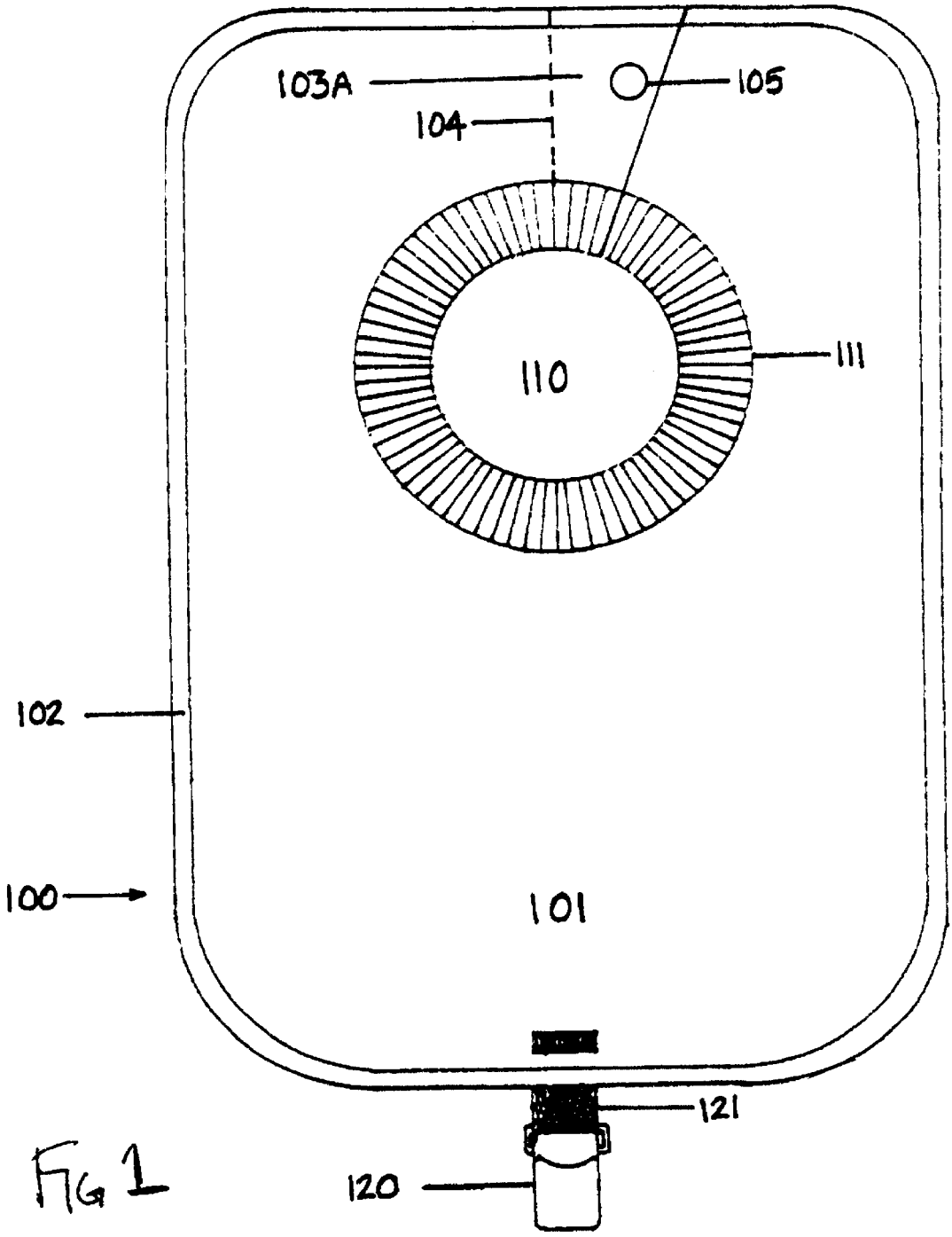
FIG. 1 is a plan view of a preferred embodiment of the instant invention.

Referring now to FIG. 1, there is shown a plan view of a preferred embodiment of the bib 100 of the instant invention. The bib includes a main body 101 which can be fabricated of any suitable material such as cloth, plastic or any suitable material. Preferably, the material is pliable or flaccid so as to readily conform to the shape of the wearer. Of course, in some instances, the material may have a sufficient stiffness to assume a prescribed configuration, if so desired.

In the embodiment shown in FIG. 1, the body 101 includes a border 102 which may be used to add strength or rigidity to the bib. The border may be merely decorative, such as piping or the like. Of course, the border may be omitted, if so desired.

At the upper end of the bib 100 is an aperture 110 which is designed to admit the head and encircle the neck of the wearer.

In this embodiment, the bib includes a discontinuity at the upper end thereof. That is, the upper end of the bib is separable and includes an overlapping area 103A at the upper end thereof. The overlapping area 103A overlaps an underlapping area 104A (indicated by the dashed line 104). These areas permit the upper end of the bib 100 to be joined together by a suitable fastener 105 which can be a snap, a button or a hook-and-loop device (available under the trademark Velcro, for example). While not specifically illustrated, the upper portion of the bib need not overlap but may merely comprise abutting ends which may be joined together by a tie strip, a drawstring or the like.

It should be understood, of course, that the bib 100 can be formed integrally, i.e. without a discontinuous or separable end portion. In this case, a fastener 105 (or similar) is unnecessary and the bib 100 merely slips over the head of the wearer which passes through opening 110. That is, the bib is a pullover device which is passed over the head of the wearer and is draped over the wearer's shoulders.

The collar 111 of the bib can be decorative as desired. In addition, the collar 111 can be fabricated of an elastic or expandable material whereby the collar 111 fits somewhat snugly (but not binding) around the neck of the wearer. This arrangement may be most likely in the case of a pullover bib.

At the bottom end of the bib 100 is attached a clip 120 which can be of any appropriate design (see infra). The clip 120 can be attached to the sheet of material 101 of bib 100 by a suitable strap 121 in any desirable fashion. In the preferred embodiment, the strap 121 is sewn or other wise attached to the fabric 101 of the bib 100. It is contemplated that this attachment may also be accomplished by any suitable fastener such as, but not limited to, a snap, a button, a Velcro-type fastener or the like.

The length of the strap 121 can be any suitable dimension including an adjustable strap. Typically, the strap 121 is of sufficient length that the clip 120 (or any similar hooking device) can be attached to the bib wearer's garments (or diaper for example) or to a suitable anchor site such as a tablecloth, a high chair or the like.

It is contemplated that the strap 121 can be of sufficient length to pass under or around the bib wearer's body so that the clip 120 can attach to the upper end of bib 100. Of course, the bib can be of sufficient dimension such that the upper end can pass behind the wearer and reach down behind the wearer (i.e. front and back portions of the bib are of similar configuration) wherein the strap 121 permits clip 120 to engage the upper (back) portion of the bib. This arrangement would be most likely in a pullover style bib.

Figure 2:
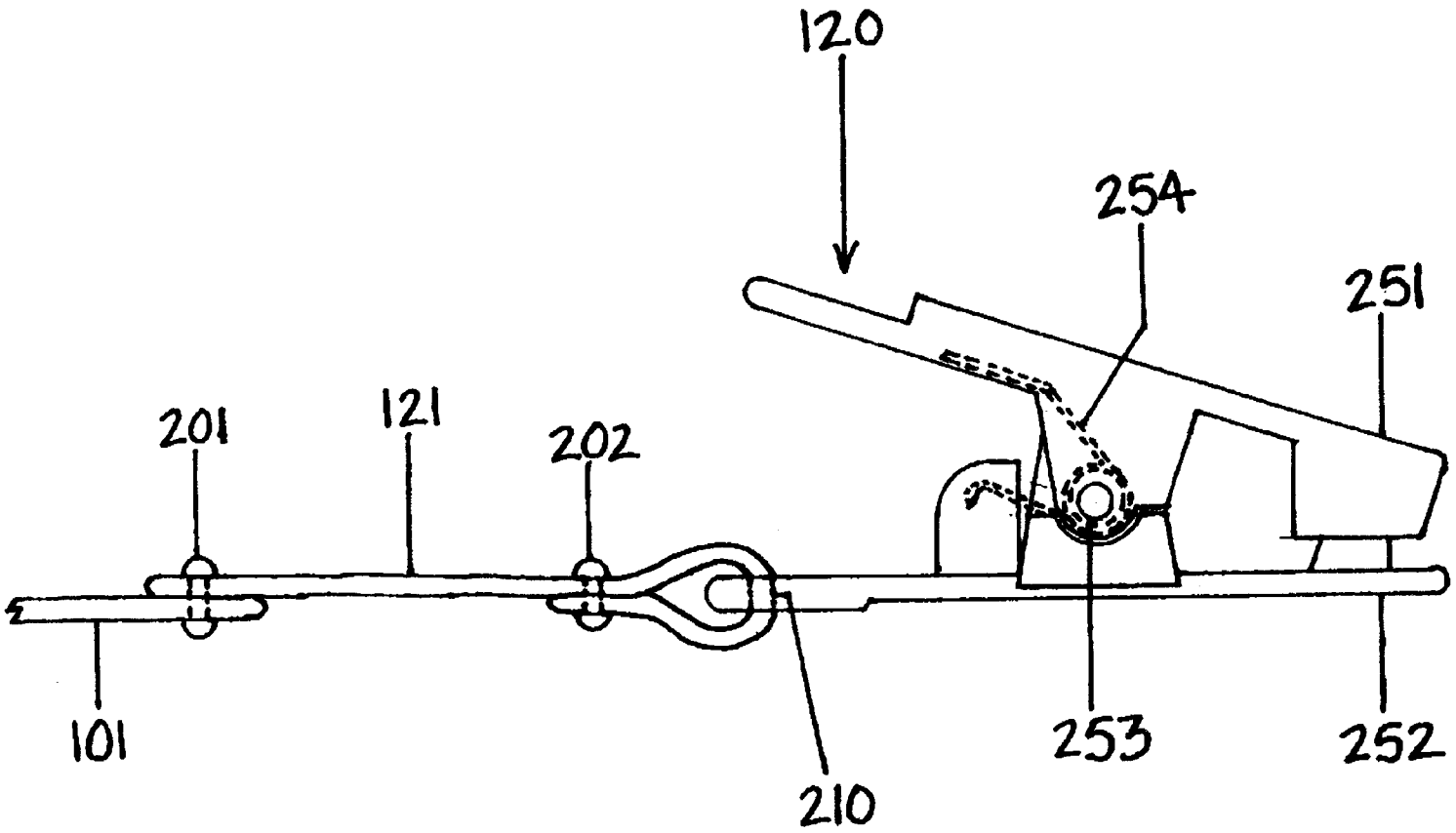
FIG. 2 is a side view of a portion of the embodiment shown in FIG. 1.

Referring to FIG. 2, there is shown a side view of the clip 120 connected to the strap 121 by a suitable fastener 201. The fastener 201 is merely representative and can be a snap, a button, a rivet, a Velcro-like fastener or merely, a sewn junction. (A heat-welded junction can be provided if the materials are appropriate.) Of course, it is also contemplated that strap 121 may be an integral extension of the bib 101.

The strap 121 is attached to clip 120 in any of a number of suitable fashions. As shown, the strap 121 is passed through an opening 210 in the clip, reversed upon itself and secured by a fastener 202 which can be any type of fastener such as described relative to fastener 201.

The clip 120 includes an upper gripping plate 251 and a lower gripping plate 252. The upper and lower gripping plates may be formed of plastic or other suitable material. The upper and lower gripping plates are pivotally mounted to each other by axle 253. A coil spring 254 (shown in phantom outline) is mounted on axle 253 in such a fashion as to force the gripping ends of the upper and lower gripping plates together, as shown. However, by applying a modest pressure on the opposite ends of gripping plates 251 and 252 of clip 120, against the force exerted by coil spring 252, the gripping ends of clip 120 are forced open to receive and grasp (or release as the case may be) a suitable anchor material such as a portion of the wearer's clothing or the like.

When the clip 120 has grasped the anchor material, as noted, the lower end of the bib is secured in the preferred position and is not free to move, pull up, drag in food of the like.

Thus, there is shown and described a unique design and concept of a secured bib. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

What is claimed is:

1. A protective covering comprising, a sheet of material adapted to be worn by a person, said sheet having an opening therethrough adjacent to a first end of said sheet and to encircle the neck of the person wearing said sheet, a retainer means connected at a second end of said sheet, said retainer means includes a spring-loaded clip, said retainer means adapted to selectively engage a substantially stationary object in order to inhibit movement of said second end of said sheet relative to the person wearing said sheet, and, an elongated connector strip joined to said retainer means and to said second end of said sheet.

2. The covering recited in claim 1 wherein, said sheet of material comprises a piece of fabric.

3. The covering recited in claim 1 including, a discontinuity in said sheet which discontinuity extends from said opening therethrough to an edge of said sheet.

4. The covering recited in claim 1 wherein.

said sheet of material can be constructed to have the appropriate dimensions so that the person wearing said sheet of material can be an adult or a child.

5. The covering recited in claim 1 wherein, said clip includes upper and lower gripping plates pivotally mounted to each other on an axle, a spring mounted on said axle to urge said upper and lower griping plates into contact.

6. The covering recited in claim 3 including, fastening means for selectively securing together the portions of said sheet on opposing sides of said discontinuity.

* * * * *